US007335856B2

(12) United States Patent
Caves et al.

(10) Patent No.: US 7,335,856 B2
(45) Date of Patent: Feb. 26, 2008

(54) APPARATUS AND METHOD OF DETECTING IGNITER TYPE

(75) Inventors: Andy Caves, Milwaukee, WI (US); Sohail Basheer, Columbia, SC (US); Richard Randals, Brookfield, WI (US)

(73) Assignee: AOS Holding Company, Wilmington, DE (US)

( * ) Notice: Subject to any disclaimer, the term of this patent is extended or adjusted under 35 U.S.C. 154(b) by 225 days.

(21) Appl. No.: 11/035,756

(22) Filed: Jan. 14, 2005

(65) Prior Publication Data

US 2005/0182521 A1 Aug. 18, 2005

Related U.S. Application Data

(60) Provisional application No. 60/538,808, filed on Jan. 23, 2004.

(51) Int. Cl.
*F23Q 7/04* (2006.01)
*F23Q 7/00* (2006.01)
*F23Q 13/00* (2006.01)

(52) U.S. Cl. ..... 219/261; 219/263

(58) Field of Classification Search ..... 219/261, 219/260, 263, 262, 265, 266, 296, 369, 380; 221/144, 145, 146; *F23Q 7/04, 7/00, 13/00*
See application file for complete search history.

(56) References Cited

U.S. PATENT DOCUMENTS 3,823,345 A * 7/1974 Mitts et al. ..... 219/267
4,398,742 A * 8/1983 Sanders ..... 280/491.3
4,925,386 A 5/1990 Donnelly et al.
5,240,406 A 8/1993 Kanesaka
5,364,260 A 11/1994 Moore
5,528,226 A 6/1996 Brown et al.
5,704,775 A 1/1998 Gilbert
5,725,368 A 3/1998 Arensmeier
6,217,312 B1 4/2001 Levinson et al.
6,415,744 B1 7/2002 Choi
6,521,869 B1 2/2003 Donnelly et al.
6,803,544 B1 * 10/2004 Zikes et al. ..... 219/263
7,039,300 B2 * 5/2006 Shah et al. ..... 392/360
7,165,784 B2 * 1/2007 Okamoto et al. ..... 280/735

* cited by examiner

*Primary Examiner*—Daniel Robinson
(74) *Attorney, Agent, or Firm*—Michael Best & Friedrich LLP

(57) ABSTRACT

The invention includes an apparatus and method of determining the type of igniter for a burner at each stage of a boiler. The apparatus includes a controller operable to detect whether a first type of igniter or a second type of igniter is installed in the burner based on whether the first type of igniter or the second type of igniter transmits a response to the controller after receiving an activation signal from the controller.

13 Claims, 5 Drawing Sheets

APPARATUS AND METHOD OF DETECTING IGNITER TYPE

RELATED APPLICATIONS

This application claims priority to U.S. application Ser. No. 60/538,808, filed on Jan. 23, 2004. The contents of U.S. application Ser. No. 60/538,808 are hereby incorporated by reference.

FIELD OF THE INVENTION

The invention relates to an apparatus, such as a boiler, and methods of controlling the apparatus.

BACKGROUND

Boilers are used in numerous situations for providing heat and/or power. One example boiler is a gas-fired boiler used for heating one or more buildings.

SUMMARY

One embodiment of the invention includes a method of determining a type of igniter for igniting gas issued by a burner of a gas-fired appliance, the gas-fired appliance adapted to comprise at least one of a first-type of igniter and a second-type of igniter different than the first-type of igniter. The method comprises the acts of applying a control parameter to the at least one of the first-type of igniter and the second-type of igniter, monitoring the at least one of the first-type of igniter and the second-type of igniter for a response to the control parameter, and determining whether the first-type of igniter or the second-type of igniter provided the response.

In another embodiment, the invention includes a gas-fired appliance comprising at least one of a first-type of igniter and a second-type of igniter different than the first-type of igniter, and a controller connected to the at least one of the first-type of igniter and the second-type of igniter, the controller being operable to detect whether the first-type of igniter and the second-type of igniter is connected to the controller based on whether at least one of the first-type of igniter and the second-type of igniter transmits a response to the controller after receiving an activation signal from the controller.

In yet another embodiment, the invention includes An apparatus for detecting a type of igniter in a boiler, the apparatus comprising a controller connectable to at least one of a first-type of igniter and a second-type of igniter different than the first type of igniter, the controller operable to detect whether at least one of a first-type of igniter and a second-type of igniter is connected to the controller based on whether at least one of the first-type of igniter and the second-type of igniter transmits a response to the controller after receiving an activation signal from the controller.

In another embodiment, the invention includes a method of determining a type of igniter for igniting gas issued by a burner of a gas-fired appliance, the gas-fired appliance adapted to comprise at least one of a first-type of igniter and a second-type of igniter different than the first-type of igniter. The method comprises the acts of applying a first control parameter to the first-type of igniter and to a control module, transmitting a second control parameter to the second-type of igniter a predetermined period of time after transmitting the first control parameter to the first-type of igniter and the control module, monitoring current through the first-type of igniter and transmitting a feedback signal to the gas-fired appliance indicative that the first-type of igniter is present if the current exceeds a threshold value, and monitoring the second-type of igniter for ignition and transmitting an ignition signal to the gas-fired appliance indicative that the second-type of igniter is present.

In yet another embodiment, the invention includes A method of determining a type of igniter for igniting gas issued by a burner of a gas-fired appliance, the gas-fired appliance adapted to comprise at least one of a first-type of igniter and a second-type of igniter different than the first-type of igniter. The method comprises the acts of transmitting an activation signal to the first-type of igniter and the second-type of igniter, and determining whether the first-type of igniter or the second-type of igniter is present in the gas-fired appliance based on whether the first-type of igniter or the second-type of igniter first ignites.

While the above aspects are described in connection with a boiler, one or more of the aspects can be applied to other apparatus, such as other gas-fired apparatus (e.g., a gas-fired water heater).

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
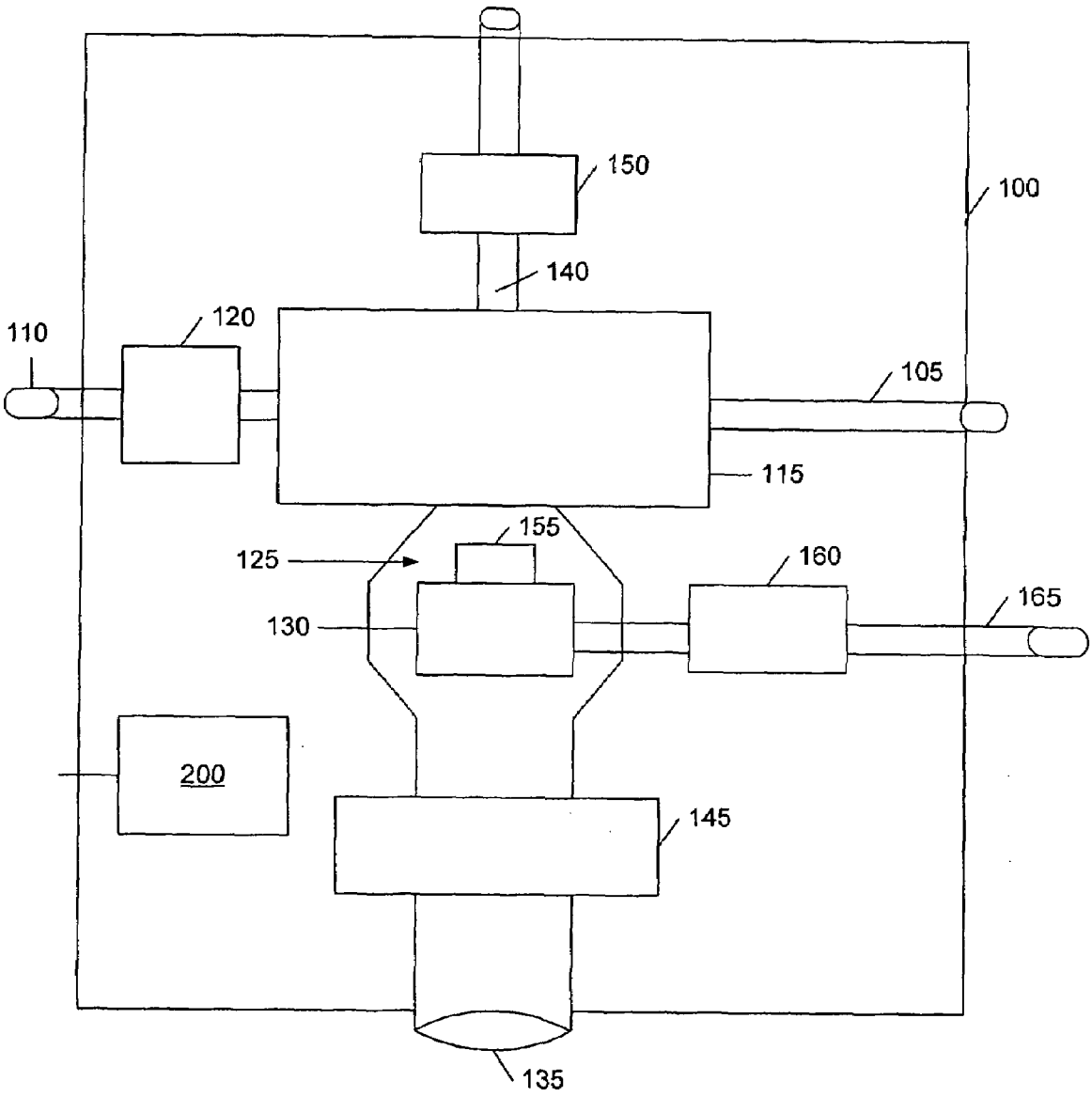
FIG. 1 is a schematic representation of a boiler.

FIG. 1 schematically shows a self-contained, gas-fired boiler 100. The boiler 100 includes inlet and outlet tubes 105 and 110, which receive and issue a fluid, respectively. While only one inlet tube and one outlet tube is shown, the number of tubes 105 and 110 can vary. The fluid can be heated as it flows through a heat exchanger 115. A pump 120 can be used to promote fluid movement through the heat exchanger 115. While only one pump 120 is shown, the number of pumps can vary. The heat exchanger 115 is heated, either directly or indirectly, by one or more burners 130 disposed in a combustion chamber 125. Unless specified otherwise, the boiler 100 will be described below as having only one burner 130 or one stage of burners. The combustion chamber 125 receives air (or similar fluid) from an air intake 135, and issues the heated air through a flue 140 or exhaust. A blower 145 and/or a powered vent 150 can be used to promote and/or restrict the airflow through the combustion chamber 125. The number of blowers and vents can vary depending on the application.

For the boiler shown in FIG. 1, one or more igniters 155 ignite the one or more burners 130. However, in other constructions, a pilot light can be used to ignite the one or more burners 130. The boiler 100 also includes one or more gas valves 160 that controllably provide a combustible gas to the burner 130 from an inlet gas tube 165.

Figure 2:
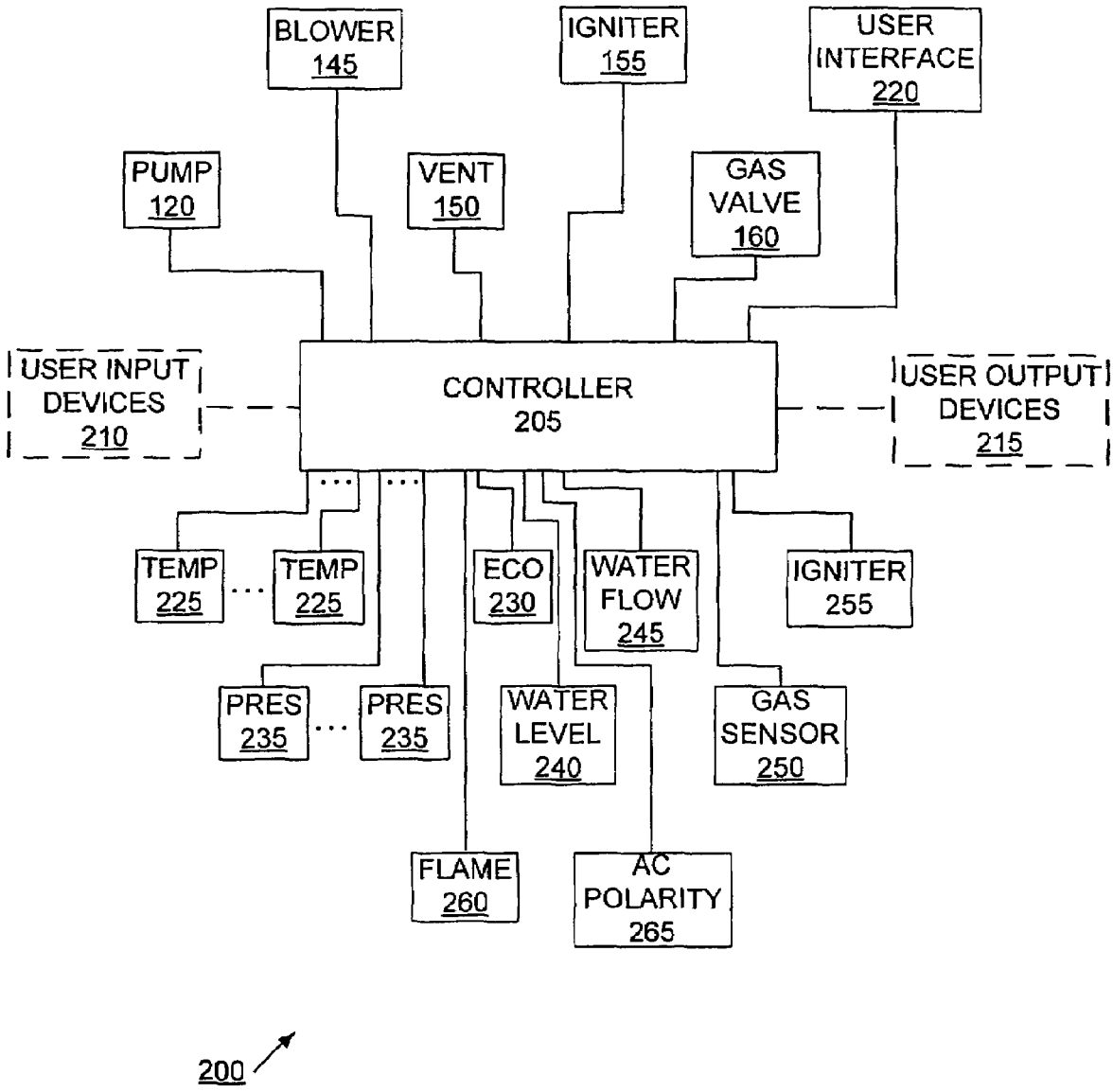
FIG. 2 is a schematic representation of one construction of a control system capable of being implement with the boiler of FIG. 1.

As shown in FIG. 2, a control system 200 provides control of the boiler 100. The control system 200 includes a controller 205, one or more user/factory input devices 210, one or more sensors, the blower 145 (or a circuit or controller that controls the blower), the powered vent 150 (or a circuit or controller that controls the powered vent), the pump 120 (or a circuit or controller that controls the pump), the igniter 155 (or a circuit or controller that controls the igniter), the gas valve 160 (or a circuit or controller that controls the gas valve), and one or more user/factory output devices 215. Of course, the control system 200 can include other control elements and not all of the control elements are required. Additionally, some of the elements of the control system 200 can be implemented in other systems coupled to the boiler.

The one or more user/factory input devices 210 provide an interface for data or information to be communicated (e.g., from a user) to the controller 205. Example input devices 210 include one or more switches (e.g., dip switches, push-buttons, etc.), one or more dials or knobs, a keyboard or keypad, a touch screen, a pointing device (e.g., a mouse, a trackball), a storage device (e.g., a magnetic disc drive, a read/write CD-ROM, etc.), a server or other processing unit in communication with the controller 205, etc. A specific example user input device is a user interface module 220 having a keypad (e.g., touch switches) for entering information or data (e.g., set point temperatures, window, etc.). The one or more user/factory output devices provide an interface for data or information to be communicated (e.g., to a user) from the controller 205. Example output devices 215 includes a display, a storage device (e.g., a magnetic disc drive, a read/write CD-ROM, etc.), a server or other processing unit in communication with the controller 205, a speaker, a printer, etc. A specific example user output device 220 is the user interface module 220 having a LCD display, a plurality of LEDs, and a speaker. Of course, other input and output devices 210 and 215 may be added or attached, and/or one or more of the input and output devices 210 and 215 may be incorporated in one device. It should also be understood, the input and/or output device(s) 210 and/or 215 can be combined with other external circuitry that may or may not be part of the control system 100. For example and as will be discussed further below, the user interface module (UIM) 220 can receive input from a user, communicate output to the user, and include other circuitry, such as temperature sensors for sensing ambient temperatures (e.g., one or more thermostat temperatures).

The sensors are coupled to the boiler 100 and provide information to the controller 205 in response to a signal or stimuli. The sensors include one or more temperature sensors or probes 225 (e.g., inlet temperature, outlet temperature, tank temperature, thermostat input, etc.), an emergency cutout (ECO) temperature probe 230, one or more pressure sensors 235 (e.g., a blocked flue sensor, a powered-vent sensor, a blower-prover sensor, a low-gas sensor, a high-gas pressure sensor), one or more water-level sensors 240, one or more water-flow sensors 245, one or more gas valve sensors 250, one or more igniter-current sensors 255, one or more flame sensors 260, an AC polarity sensor 270, etc. Additional sensors can be added and not all of the above-listed sensors are required in all constructions. Further, the sensors can be directly coupled with other elements of the control system 200 such that a single communication path is provided for controlling the element and obtaining information from the coupled sensor. It should also be understood that the communication can be wire communication and/or wireless communication.

The ECO 230 is a thermostat switch and is located inside a probe disposed in or near the outlet pipe 110. The ECO 230 is a normally closed switch that opens if the probe is exposed to a temperature higher than a trip point of the probe. As will be discussed below, electrical power for the gas valve relay 160 is passed through the ECO 230. When open, the relay will turn off, and in turn, will shut off the gas supply.

Figure 3:
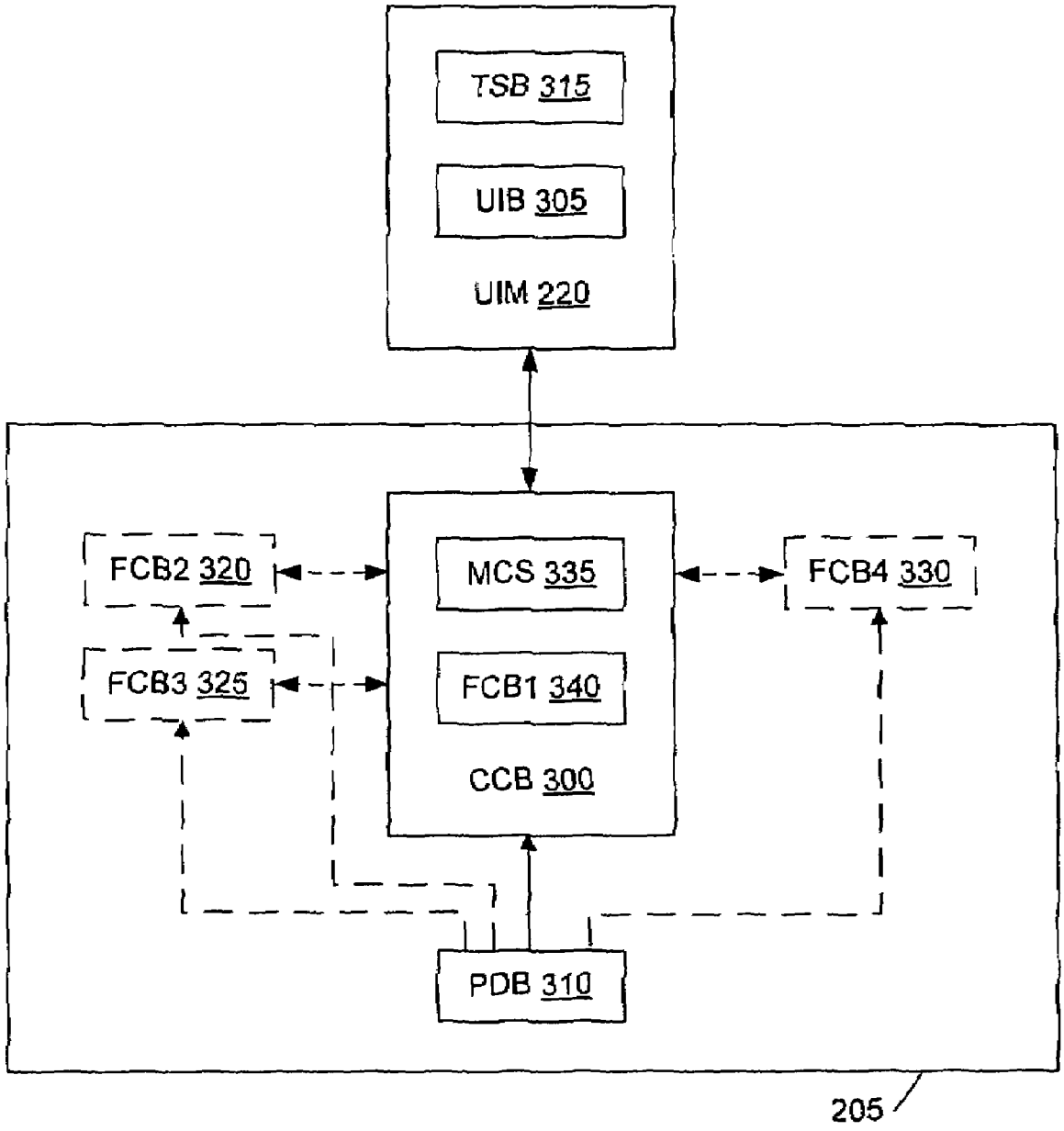
FIG. 3 is a schematic representation of one construction of a controller capable of being implemented with the control system of FIG. 2.

In general, the controller receives inputs (data, signals, information, etc.) from the one or more sensors 225-265 and the one or more input devices (e.g., the user/factor input devices 210, the UIM 220, etc.); processes and/or analyzes the signals; and communicates the processed signals and/or outputs control signals, in response to the processed or analyzed signals, to the one or more output devices (e.g., the user/factor output devices 215, the pump 120, the blower 145, the gas valve 160, the igniter 155, the powered vent 150, and/or UIM 220). A more detailed schematic of one construction of the controller is shown in FIG. 3.

The controller 205 includes a central control board (CCB) 300 that communicates with multiple secondary boards, which may or may not be part of the controller 205. Example secondary boards include a user interface board (UIB) 305, a power distribution board (PDB) 310, a touch sensor board (TSB) 315, and one or more flame control boards (FCB2-FCB4) 320, 325, and 330.

The CCB 300 is the central controller of the control system 200, and contains conditioning circuits, driver or control circuits, a long-term memory circuit(s) for storing data, DC power supplies, an internal communication circuit, and two communication ports. The CCB 300 includes a master control section (MCS) 335 and a flame control section (FCB1) 340. The MCS 335 includes a MCS microcontroller, and the FCB1 section includes a FCB1 microcontroller and a silicon-nitride (Si3N4) microcontroller. In one construction, the MCS microcontroller is a Microchip brand PIC18F6620-I/PT microcontroller, the FCB1 microcontroller is an Atmel brand AT89C55WD-24JI microcontroller, and the Si3N4 microcontroller is a Microchip brand PIC16F876-201/SO microcontroller. The Si3N4 microcontroller connects to a Si3N4 igniter (discussed further below) to operate the Si3N4 igniter. Each microcontroller includes an analog-to-digital converter, a processing unit (e.g., a microprocessor), and a memory. The memory includes one or more software modules (which may also be referred to herein as software blocks) having instructions. The processing unit obtains, interprets, and executes the instructions to perform processes.

Each conditioning circuit receives input signal(s) from the one or more input devices (e.g., sensors) and conditions the input signal(s) to the proper voltage and/or current range for an attached microcontroller (e.g., the MCS microcontroller, the FCB1 microcontroller, etc.). Each driver or control circuit receives output(s) from one or more microcontrollers and controls an attached output device (e.g., pump, blower, etc.) using the received output signal. The board communication circuit and the internal and external ports promote internal and external communications, respectively. The internal communication port connects to internal communication ports of the other control modules (e.g., the UIM 220, the FCBs 320, 325, and 330) using an RS-485 communication bus, thereby providing an internal communication network. The external communication port (also known as the network port) can be used to connect the control system 200 to a personal computer, a building automation system, a local area network, the Internet, a modem, or the like.

The MCS microcontroller controls the overall operation of the boiler. This includes controlling the heating process, including the steps of receiving inputs from the one or more sensors, sending calls for heat to the FCB microcontroller(s), and sending calls for idle to the FCB microcontroller(s) once the heat has been satisfied. The MCS microcontroller also controls the powered vent and the pump, and provides a safety control for the gas valve.

In response to control signals from the MCS microcontroller, the FCB microcontroller(s) executes a software program resulting in the control of the flame. The FCB controls the blower, gas valve, and igniter. For a Si3N4 igniter, the FCB provides an output to the Si3N4 microcontroller when activating the igniter. Once the igniter is lit, the Si3N4 microcontroller returns a signal to the FCB microcontroller informing the FCB of the operation. Other communication from the Si3N4 microcontroller to the FCB microcontroller includes error codes.

The FCB1 340 has one stage of combustion and flame safety control, and includes blower control, igniter control, and flame-detect circuitry. As additional safety checks, the gas relay output, igniter current, and blower outputs are monitored. For a multiple stage boiler, a separate flame control board (e.g., FCB2, FCB3, or FCB4) is used for each stage. Each flame control board includes a FCB microcontroller, conditioning circuitry, control or driver circuitry, internal communication circuitry, and a Si3N4 microcontroller. Each FCB controls a respective blower, gas valve, and igniter, and includes an internal communication port for communicating with the MCS 335.

The use of multiple boards and microcontrollers allow for the modularity of the construction shown in FIG. 3. However, other constructions are possible. For example, the functionality of the separate flame control boards 320, 325, and 330 can be combined with the FCB1 340, resulting in a single FCB microcontroller controlling all stages of combustion. As another example, a single processing unit can be used for the controller 205.

The UIM 220 allows full setup and operation of the boiler. The UIM 220 includes a housing that supports the UIB 305, the TSB 315, a LCD display, LED indicators, and touch switches. The UIB 305 provides means to both send and receive information to and from the user. The UIB 305 communicates with the CCB 300 and controls the operation of the LCD. The UIB 305 also receives inputs from the touch switches, and activates the LEDs according to signals provided by the CCB 300. The TSB 315 includes the switch pads for the UIM 220 and provides inputs to the UIB 305. The LEDs indicate the status of the boiler (e.g., running (Green), standby (Yellow), and service (Red), etc.).

The PDB 310 distributes 120 VAC and 24 VAC power to the CCB 300 and the FCBs 320, 325, and 330. The PDB 310 also provides fusing for the control system 200 and a test circuit for determining if line power is properly applied to the system.

The hardware is controlled by software that is embedded in the microcontrollers. For the construction shown in FIG. 3, four different software programs provide system control: a master control software program for the CCB microcontroller, a flame control software program for the FCB microcontroller(s), a user interface software program for the UIB microcontroller, and a Si3N4 software program for the Si3N4 microcontroller. These microcontrollers communicate with each other over the internal network.

As was discussed earlier, the ECO 230 is a thermostat switch, which is located inside a probe disposed in or near the outlet pipe 110. The ECO 230 is a normally closed switch that opens if the probe is exposed to a temperature higher than a trip point of the probe. Electrical power for the gas valve 160 passes through a relay controlled by the current flowing through the ECO 230. When the ECO 230 opens, the ECO-controlled relay will in turn open, thereby de-energizing the gas valve 160. The ECO 230 and the ECO-controlled relay perform a safety function. If the water temperature gets too hot, the opening of the ECO 230 will automatically override all of the other circuitry and shut off the power to the gas valve 160. Software cannot de-bounce this physical action and the status of the ECO 230 is also passed to the MCS microcontroller.

In some constructions of the control system 200, additional relays can be added to control the operation of the gas valve 160. The redundancy of the relays reduces the possibility of a component failure accidentally turning on the gas valve 160 at an improper time. One example construction of a circuit 400 for controlling operation of the gas valve 130 is shown in FIG. 4.

Figure 4:
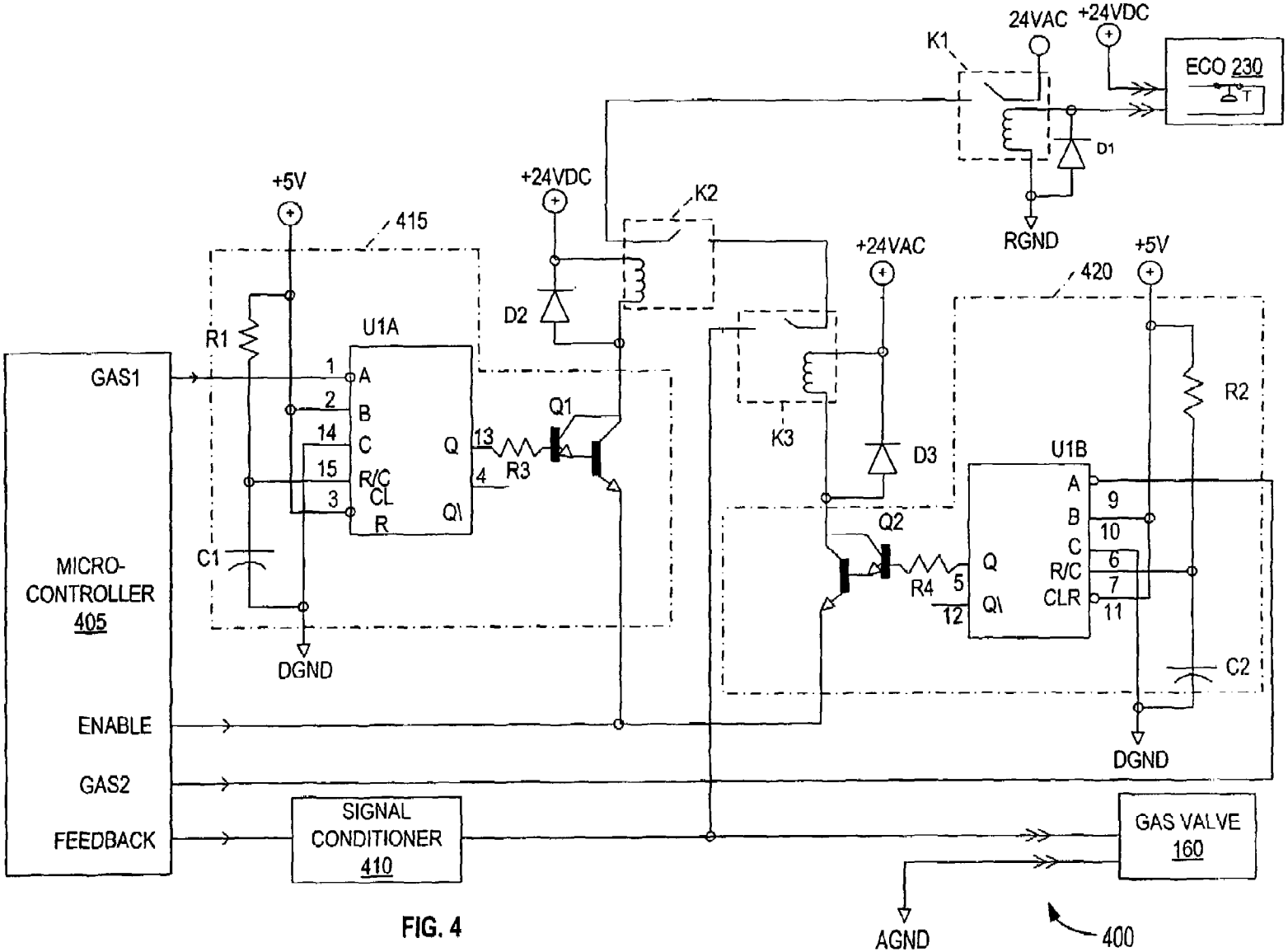
FIG. 4 is a partial electrical schematic/block diagram of a gas valve control circuit capable of controlling the gas valve shown in FIG. 1.

With reference to the construction of the gas valve control circuit 400 shown in FIG. 4, the gas valve power is routed through three separate relay contacts. All three relays K1, K2, and K3 are normally open and must be closed at the same time in order to route power to the valve 160. Relay K1, which is the ECO-controlled relay, is the first relay in the string. Similar to what was previously discussed, the contacts of relay K1 are closed when the ECO (Emergency Cut Out switch) is closed. If the ECO 230 is still open when the microcontroller 405 tries to turn on the gas valve 160, the microcontroller 405 identifies a problem due to a lack of feedback from the signal conditioner 410. The controller 205 can then declare a fault and inform the user of the problem via the UIM 230. If the ECO contacts are closed when the microcontroller 405 attempts to open the gas valve 160, the relay-control circuits 415 and 420 then control whether the valve 160 opens.

The relay-control circuits 415 and 420 are connected to the microcontroller 405, which for the controller shown in FIG. 3 is one of the FCB microcontrollers, and are used to activate relays K2 and K3, respectively. The microcontroller 405 includes multiple outputs GAS1 and GAS2 to prevent a problem of one output or port from affecting both relays K2 and K3. Since the relay-control circuits 415 and 420 shown in FIG. 4 are identical, only relay-control circuit 415 will be discussed in detail.

With reference to FIG. 4, relay-control circuit 415 includes a one-shot multivibrator U1A, a transistor Q1, resistors R1 and R3, and a capacitor C1. The output signal GAS1 is a pulsing signal when active. The pulsing signal is pulsed at a set frequency to control the one-shot multivibrator U1A. In order to activate the one-shot multivibrator U1A, the pulsing signal should have repetitive transitions from high to low in approximately less time than the effective pulse width (or time constant) of circuit R1, C1, which is applied to the one-shot multivibrator U1A. If the transitions are faster than the effective pulse width of the circuit R1, C1, the Q output of the multivibrator U1A goes high and turns on the transistor Q1. The activating of the transistor Q1 activates the relay K2. If the transition is slower than the pulse width of the circuit R1, C1 or some pulses are missed, the Q output of the multivibrator U1A goes low and turns off the switch Q1. The deactivating of the transistor Q1 deactivates the relay K2. The resistor R3 limits the current through the switch Q1, and the diode D1 reduces the "kick-back" voltage on the coil of the relay K2 when the relay is deactivated. In addition to providing the proper pulsing signals GAS1 and GAS2, the microcontroller 405 also drives the ENABLE signal low to turn on the relays K2 and K3.

In order for the gas valve 160 to open, all three relays K1, K2, and K3 need to be closed at the same time. That is, the outlet water temperature must be less than the set point of the ECO 230, the microcontroller 405 must pulse the signals GAS1 and GAS2 at approximately the proper rate, and the Enable line be pulled low to close both of the relays K2 and K3. If any of these conditions are not met, the gas valve 160 will not operate.

Further, control of the gas valve 160 can occur even if one of the relays K2 or K3 shorts. For example, if relay K3 shorts, relay K2 would still provide control of the gas valve 160, including turning the gas valve 160 off.

Again with reference to FIG. 4, the microcontroller 405 also monitors the signal FEEDBACK to know when power is being applied to the gas valve 160. By comparing the signal FEEDBACK to the requested output, the microcontroller 405 can declare a fault if the microcontroller 405 detects a problem. For example, a fault can be declared if power is not properly applied to the gas valve 160 when commanded, or power is applied to the gas valve 160 when not commanded. For a specific example, if the contacts of both relays K2 and K3 are shorted, power can be applied to the gas valve 160 irrespective of whether the valve 160 is to be opened or closed. The microcontroller 405 detects if power is erroneously provided to the gas valve 160 by the signal FEEDBACK and declares a fault to the user. If the user does not respond to the fault, the gas valve 160 remains on until the outlet water reaches the ECO thermostat temperature. This deactivates relay K1, which closes the gas valve 160.

Before proceeding further, it should be noted that while the control circuit 400 was described as controlling the gas valve 160, the circuit 400 can control other valves or apparatus. Additionally, while the circuit was described with the relay-control circuits 415 and 420, other circuits can be used for controlling relays K2 and K3.

As discussed earlier with reference to FIG. 1, the boiler 100 includes an igniter 155 to ignite the burner 130. In one construction, the igniter 155 comprises a silicon-carbide (SiC) material, and in another construction, the igniter 155 comprises a silicon-nitride (Si3N4) material. In some constructions of the control system 200, the system 200 allows either material to be used as the igniter 155. Furthermore, for these constructions, the controller 205 can automatically determine the type of igniter 155 connected to the controller 205. One example construction of a circuit 500 for detecting the igniter type connected to the controller 205 is shown in FIG. 5.

Figure 5:
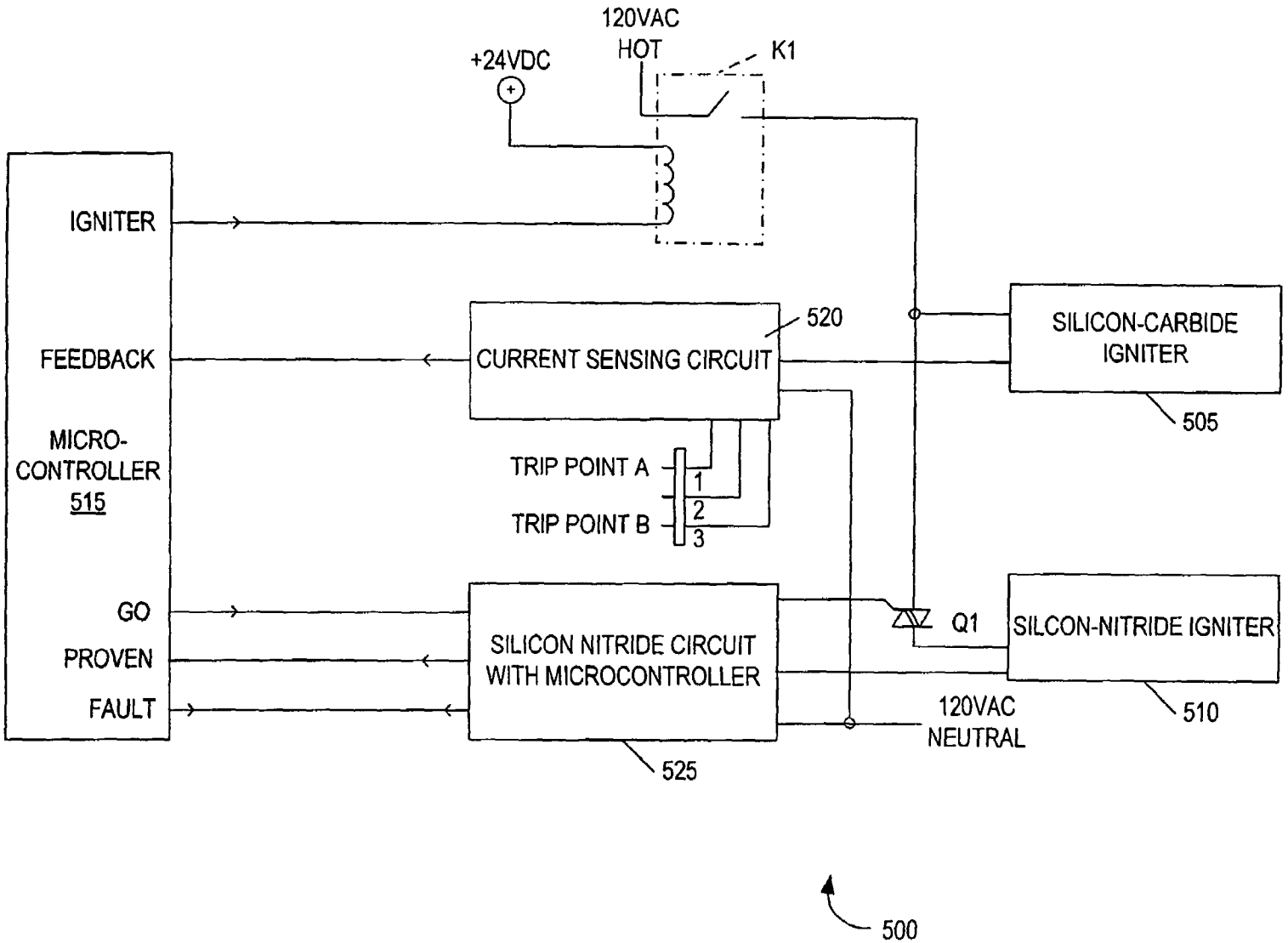
FIG. 5 is a partial electrical schematic/block diagram of an igniter detect circuit capable of detecting the igniter shown in FIG. 1.

With reference to FIG. 5, either a SiC igniter 505 or a Si3N4 igniter 510 connects to the controller 515 and is used for igniting the burner 130. The igniter 505 or 510 can be installed at the factory or installed "on-location" by a service technician. The microcontroller 515 can be one of the FCB microcontrollers described in connection with FIG. 3.

As shown in FIG. 5, the SiC igniter 505 lights the burner 130 when the signal IGNITER causes relay K1 to close. A conventional current proving circuit 520 monitors the current through the igniter 505 to insure that the igniter 505 has sufficient current to produce ignition temperature. When the current exceeds a set value, the circuit 520 provides a signal to microcontroller 515 indicating that the igniter is on. The set point can be set using jumpers and can depend on the type of the SiC igniter 505.

With reference again to FIG. 5, a Si3N4 microcontroller and control circuit 525 controls the Si3N4 igniter 510. An exemplary Si3N4 microcontroller 525 is distributed by White-Rodgers, at http://www.white-rodgers.com, as part no. 21D64-100E1. An exemplary control circuit for controlling the Si3N4 igniter is disclosed in U.S. Pat. No. 6,521,869, which is incorporated herein by reference. When activating the Si3N4 igniter, the signal IGNITER is driven low to turn on K1 and apply power to triac Q1. A short time later, a "go" signal is communicated to the Si3N4 microcontroller 525. The Si3N4 microcontroller and control circuit 525 ignites the Si3N4 igniter 510 in response to the "go" signal, by activating triac Q1. If ignition is successful, a successful result is communicated (on the "Proven" line) from the Si3N4 microcontroller to the microcontroller 515. If a fault occurs, the fault is communicated from the Si3N4 microcontroller to the microcontroller 515. The signal FAULT provides fault information to the microcontroller 515 and allows microcontroller 515 to clear the fault condition(s). In a different construction, the triac Q1 is directly connected to line power such that the relay K1 is not required.

When attempting to activate the igniter for the first time after a power-up, the controller 515 automatically determines the type of igniter installed on each stage of the boiler 100 (if more than one stage). Of course, the determination can be made at a different time. The determination can be made similarly for each stage, so only one stage will be explicitly discussed herein.

In one method, the microcontroller 515 first attempts activating the SiC igniter as discussed above. The microcontroller 515 then monitors the signal FEEDBACK from the current sensing circuit 520 to determine whether a positive result occurs at anytime up to when the Si3N4 returns a positive "Proven" feedback. If the result is positive, the microcontroller 515 stores the result in memory. If a positive result does not occur after a short time period, the microcontroller 515 then provides a "go" signal to the Si3N4 microcontroller and control circuit 525. The microcontroller 515 then monitors whether a positive reply is provided back from the Si3N4 microcontroller 525 within a time period. If a positive feedback is received from the current sensing circuit 520 at any time before a positive "Proven" feedback is received, the "Go" signal is removed to stop the Si3N4 process. If the result is positive, the microcontroller 515 stores the result in memory. If a positive feedback signal is not received from either type of igniter, the controller 205 stops the igniter process and declares an error. The detected type of igniter is stored in memory, and all subsequent operations will only activate the detected type until cycling power clears the memory. Of course, the order of the steps of the just discussed method can vary and other methods are possible.

As an alternative method, the microcontroller 515 provides an activation signal to both the SiC igniter control circuit and the Si3N4 igniter control circuit at substantially the same time. The microcontroller 515 activates the SiC circuitry by enabling the output line IGNITER and activates the Si3N4 circuitry by enabling the output line GO. Feedback signals from both the current sensing circuit 510 and the Si3N4 microcontroller are then monitored to determine which igniter is installed. If a positive result is received from the current sensing circuit, the microcontroller 515 knows that the stage has a SiC igniter 505 and activation of the Si3N4 igniter 510 is no longer needed. The system would then cancel the "go" command to the Si3N4 control circuit. If no current feedback is seen in a time period, then the microcontroller 515 waits for feedback from the Si3N4 microcontroller. If the Si3N4 microcontroller 515 completes its ignition sequence and returns a positive result, then a Si3N4 igniter 510 is coupled to the controller 205. The detected type of igniter is stored in memory, and all subsequent operations will only activate the detected type until cycling power clears the memory. If the feedback indicates that neither of the igniters is connected then a fault is declared. If both types of igniters are installed, the microcontroller can use one type of igniter for all subsequent operations and ignore the other. For example, in one embodiment, if both type of igniters are installed, the microcontroller will default to the SiC igniter and ignore the Si3N4 igniter for all subsequent operations.

In yet another method, the microcontroller 515 first attempts activating the Si3N4 igniter as discussed above. In this embodiment, the triac Q1 is connected to line power such that the relay K1 is not connected in series with the triac Q1. The microcontroller 515 transmits a "go" signal to the Si3N4 microcontroller 525. The Si3N4 microcontroller and control circuit 525 ignites the Si3N4 igniter 510 in response to the "go" signal, by activating triac Q1. The microcontroller 515 then monitors the Proven signal from the Si3N4 microcontroller 525 for a period of time to determine if ignition of the Si3N4 igniter 510 is successful. If the result is positive, the microcontroller 515 stores the result in memory. If the result is negative, the microcontroller 515 transmits the signal IGNITER to close relay K1 and activate the SiC igniter 505. The microcontroller 515 then monitors the signal FEEDBACK from the current sensing circuit 520 to determine whether a positive result occurs within a time period. If the result is positive, the microcontroller 515 stores the result in memory. The detected type of igniter is stored in memory, and all subsequent operations will only activate the detected type until cycling power clears the memory. If a positive result is not received from either igniter, a fault is declared. Of course, the order of the steps of the just discussed method can vary and other methods are possible.

As was discussed earlier with reference to FIG. 2, the control system 200 can include a user interface module (UIM) 220 that receives input from a user. The UIM 220 allows, among other things, full setup and operation of the boiler 100. The setup can include one or more temperature set points (e.g., an operating set point, a high limit set point, etc.) and one or more temperature differentials (e.g., a temperature differential of one degree Celsius for a set point). The controller 205 uses the set point(s), the temperature differential(s), and sensed temperature information to control the boiler 100.

In one method of operation, the controller 205 operates in one of at least two states (a normal state and a short-cycling-prevention state) and each state has at least two modes (a running mode, where the heating sequence is active, and a standby mode, where no heat is needed). When in the normal state, the boiler 100 operates as set or programmed by the user. When in the short-cycling-prevention state, the boiler 100 adjusts operation of the boiler 100 such that the controller 205 does not strictly follow the settings created by the user (i.e., modifies the normal state). Of course, other states and modes can be added (e.g., an error state, a vacation or sleep state), and the descriptors used for each state and mode (e.g., "normal" state, "running" mode, etc.) are only meant as example descriptors (e.g., the "normal" state can alternatively be referred to as the "standard" state or variations thereof). It should also be understood that the short-cycling-prevention state can modify other states and not just the normal state as discussed herein.

The term "short-cycling condition" is referred to herein as a condition where the boiler 100 performs at a rapid cycling rate, each cycle including the activation and deactivation of the burner 130. For example and in one construction, the boiler 100 is in a short-cycling condition when one or more stages of the boiler 100 performs thirty cycles in one hour. A short-cycling condition can occur, for example, when the temperature differential is set too tight. Short cycling increases the number of cycles performed by the boiler 100, and can lead to premature failure of one or more components of the boiler 100.

The short-cycling-prevention state affects the operation of the standby and/or running modes. For example, the short-cycling-prevention state can adjust one or more set values to a default value (e.g., automatically change the temperature differential to three degrees Celsius, change a temperature set-point, etc.), can adjust a set value (e.g., increase the temperature differential of the normal state by one degree Celsius/hour until the short cycling condition ceases), and/or can force a minimum amount of time to elapse before allowing cycling to occur (e.g., delay a call for heat for a minimum of at least 180 seconds after the last call for heat). One result of the short-cycling-prevention state is the delaying of one or more cycles such that the number of cycles in a time period is reduced.

For one construction, the controller 205 issues an alarm informing the user that a short-cycling condition occurred when the controller 205 enters the short-cycling-prevention state. For this construction, the controller 205 stays in the short-cycling-prevention state until the user acknowledges the condition. In another construction, the controller 205 operates in the short-cycling-prevention state for a time period upon detecting the short-cycling condition. After the time period has lapsed, the controller 205 returns to the normal state (or other applicable state) to determine whether the condition causing the short-cycling has resolved itself. If not, then the controller 205 will re-enter the short-cycling-prevention state and an alarm will occur. Other variations are envisioned.

It should also be noted that the short-cycling-prevention state can be independently determined and controlled for each heating stage. Alternatively, the short-cycling-prevention state for each of the heating stages can be related. For example and in one method, if the short cycling-prevention state was entered while the system was in idle, then the next transition to the heating sequence for stage 1 will not be allowed for 180 seconds. Then, when the sequence reaches the end of the heating sequence for stage 1, the controller 205 will wait 180 seconds before entering the heating sequence for stage 2, and so on.

While the invention has been described in connection with the self-contained, gas-fired boiler, the invention can be used in other boiler types. Additionally, it is contemplated that aspects of the invention can be used with other appliances (e.g., a gas-fired appliance such as a water heater).

Various features and advantages of the invention are set forth in the following claims.

What is claimed is:

1. A method of determining a type of igniter for igniting gas issued by a burner of a gas-fired appliance, the gas-fired appliance adapted to comprise at least one of a first-type of igniter and a second-type of igniter different than the first-type of igniter, the method comprising:

applying a first control parameter to the first-type of igniter and to a control module;

transmitting a second control parameter to the second-type of igniter a predetermined period of time after transmitting the first control parameter to the first-type of igniter and the control module;

monitoring current through the first-type of igniter and transmitting a feedback signal to the gas-fired appliance indicative that the first-type of igniter is present if the current exceeds a threshold value; and monitoring the second-type of igniter for ignition and transmitting an ignition signal to the gas-fired appliance indicative that the second-type of igniter is present.

2. The method of claim 1 further comprising storing the type of igniter in memory that corresponds to whether the burner receives the feedback signal or the ignition signal.

3. The method of claim 1 wherein subsequent operations of the burner only activate the type of igniter that is stored in memory.

4. The method of claim 1 wherein the first-type of igniter comprises a first material and the second-type of igniter comprises a second material different than the first material.

5. The method of claim 1 wherein the first type of igniter comprises silicon carbide and the second type of igniter comprises silicon nitride.

6. The method of claim 1 wherein the first type of igniter comprises silicon nitride and the second type of igniter comprises silicon carbide.

7. The method of claim 1 further comprising transmitting a fault condition if neither the first type of igniter or the second type of igniter is connected to the burner.

8. The method of claim 1 further comprising canceling the act of transmitting a voltage signal to the control module if the first-type of igniter transmits the feedback signal.

9. The method of claim 1 wherein the gas-fired appliance includes a plurality of burners, and wherein each burner can include one of the first-type of igniter and the second-type of igniter.

10. The method of claim 1 wherein the applying a first control parameter comprises applying a voltage tot he first-type of igniter and the control module.

11. A method of determining a type of igniter for igniting gas issued by a burner of a gas-fired appliance, the gas-fired appliance adapted to comprise at least one of a first-type of igniter and a second-type of igniter different than the first-type of igniter, the method comprising:

transmitting an activation signal to the first-type of igniter and the second-type of igniter; and determining whether the first-type of igniter or the second-type of igniter is present in the gas-fired appliance based on whether the first-type of igniter or the second-type of igniter first activates.

12. The method of claim 11 wherein transmitting the activation signal to the first-type of igniter and the second-type of igniter comprises sequentially transmitting the activation signal to one of the first-type of igniter and the second-type of igniter.

13. The method of claim 11 wherein transmitting the activation signal to the first-type of igniter and the second-type of igniter comprises transmitting the activation signal to the first-type of igniter and the second-type of igniter at the same time.

* * * * *